United States Patent [19]

Tazaki et al.

[11] Patent Number: 4,761,897

[45] Date of Patent: Aug. 9, 1988

[54] SCREW CONVEYOR TYPE DRYING APPARATUS

[75] Inventors: Mitsuo Tazaki, Takarazuka; Kenji Ohata, Wakayama, both of Japan

[73] Assignee: Kubota, Ltd., Osaka, Japan

[21] Appl. No.: 131,247

[22] Filed: Dec. 7, 1987

Related U.S. Application Data

[63] Continuation of Ser. No. 905,785, Sep. 9, 1986, abandoned.

[30] Foreign Application Priority Data

Jan. 25, 1986 [JP] Japan ..... 61-14426

[51] Int. Cl.[4] ..... F26B 17/20

[52] U.S. Cl. ..... 34/180; 34/183; 366/300; 366/301; 366/320

[58] Field of Search ..... 34/182, 183, 181, 39, 34/180; 366/300, 301, 320, 321, 323

[56] References Cited

U.S. PATENT DOCUMENTS

| | | | |
|---|---|---|---|
| 2,636,284 | 4/1953 | Napier . | |
| 3,646,689 | 3/1972 | Kuchenthal | 34/182 |
| 3,678,596 | 7/1972 | Kubo | 34/182 |
| 3,800,865 | 4/1974 | Onarheim et al. | 34/183 |
| 4,214,376 | 7/1980 | Lucke . | |
| 4,281,934 | 8/1981 | Krause et al. . | |
| 4,417,697 | 11/1983 | Saiki et al. . | |

FOREIGN PATENT DOCUMENTS

| | | |
|---|---|---|
| 0031604 | 7/1981 | European Pat. Off. . |
| 0090261 | 10/1983 | European Pat. Off. . |
| 131976 | 8/1982 | Japan . |
| 193994 | 12/1984 | Japan . |
| 20448 | of 1913 | United Kingdom . |
| 1581859 | 12/1980 | United Kingdom . |

*Primary Examiner*—Larry I. Schwartz

*Attorney, Agent, or Firm*—W. G. Fasse; D. H. Kane, Jr.

[57] ABSTRACT

A screw conveyor type drying apparatus has a plurality of hollow drive shafts each having a plurality of hollow feed vanes located on the respective drive shaft along an imaginary helix positioned on the outer peripheral surface of the drive shaft. The drive shafts are driven so that adjacent drive shafts are rotated in mutually opposite directions, whereby a material to be dried is conveyed. A heating fluid supply device feeds heating fluid into the hollow internal of the feed vanes through the hollow drive shafts, whereby the material coming in contact with the feed vanes during conveyance is heated and dried.

14 Claims, 11 Drawing Sheets

SCREW CONVEYOR TYPE DRYING APPARATUS

This application is a continuation of application Ser. No. 905,785, filed on Sept. 9, 1986, now abandoned.

BACKGROUND OF THE INVENTION

1. Field of the Invention

This invention relates to a screw conveyor type drying apparatus used for drying dehydrated sludge discharged, e.g., from sewage or excrement treatment plants or for drying feed or food which is high in water content.

2. Description of the Prior Art

Japanese Patent Application Laying-Open No. 131976/1982 discloses an example of a screw conveyor type drying apparatus for the aforesaid use, as shown in present FIG. 16 marked "Prior Art". A casing 100 is provided at one end thereof with a charge port 101 for material to be dried and a discharge port 102 for dried material. Disposed within the casing 100 is a hollow drive shaft 103 rotatably supported by the opposite ends of the casing 100. The drive shaft 103 carries a plurality of feed vanes 104 of hollow construction which continuously extended along an imaginary helix positioned on the outer peripheral surface of the drive shaft 103. Further, to dry material, there is provided a mechanism whereby heating fluid 105 is fed into the hollow areas of the feed vanes 104 through the drive shaft 103 and then discharged therefrom.

In the drying apparatus described above, a material to be dried which is charged into the inlet part 101 of the casing 100 is conveyed to the discharge port 102 as the feed vanes 104 are rotated along with the drive shaft 103, and at the same time the material is heated and dried by the heating fluid 105 fed into the feed vanes.

According to the aforesaid drying apparatus, however, since the feed vanes 104 are formed continuously around the periphery of the drive shaft 103, i.e., continuously along the imaginary helix positioned on the outer peripheral surface of the drive shaft 103, there has been a problem that the rate of travel of the material is so high that the material is discharged through the discharge port 102 before it is fully dried. On the other hand, if the rate of travel of the material is reduced, the material cannot be stirred sufficiently. Furthermore, since the material is rotated along with the feed vanes 104, structurally, the stirring efficiency is inherently low; therefore, the material cannot be dried uniformally and the drying efficiency is not sufficiently high.

On the other hand, Japanese Patent Application Laying-Open No. 131976/1982 discloses a conveyor type drying apparatus shown in present FIG. 17 also marked "Prior Art". FIG. 17 shows a hollow drive shaft 113 rotatably installed in a casing 110, with a plurality of hollow vanes 114 attached to the outer periphery of the drive shaft 113. As for the positional arrangement of the feed vanes 114, however, sets of four feed vanes 114 are spaced along the length of the drive shaft 113, the four vanes in each set being spaced around the same circumference. Thus, despite the fact that the feed vanes 114 cross the axis of the drive shaft 113, a material to be dried cannot be dried efficiently. Further, since the four feed vanes 114 in each set are spaced around the same circumference, there has been a problem that the stirring efficiency is not high. As a result, there has been a drawback that conveying and drying a material in such a known apparatus requires a relatively large amount of energy.

Japanese Utility Model Application No. 193994/1984 discloses a conveyor type drying apparatus using paddles 124 which are sector shaped in a plan view as shown in FIGS. 18 and 10, also marked "Prior Art". More particularly, a plurality of pairs of paddles 124 are spaced along the length of a drive shaft 123, the two paddles 124 in each pair being spaced around the same circumference. In this drying apparatus, heating fluid is fed into the paddles 124, whereby a material to be dried which comes in contact with the paddles 124, is dried. As is clear from FIG. 18, the paddles 124 are disposed at right angles to the drive shaft 123. Thus, the paddles 124 themselves do not serve to convey the material; whereby the material cannot be conveyed efficiently. Thus, there has been a drawback that in conveyance, the casing 130 must be inclined or a relatively large amount of energy must be supplied.

SUMMARY OF THE INVENTION

Accordingly, an object of the invention is to provide a conveyor type drying apparatus having such a construction that a material to be dried can be dried while it is being fully stirred without requiring a large amount of energy for conveyance.

A conveyor type drying apparatus according to this invention includes a casing having a material charging port and a material discharging port which are spaced a predetermined distance in the direction of conveyance. Disposed in the casing are a plurality of hollow drive shafts extending in the direction of conveyance. Drive means is provided for driving the plurality of drive shafts so that adjacent drive shafts are rotated in mutually opposite directions. The outer peripheral surface of each drive shaft is provided with feed vanes of hollow construction spaced a predetermined distance from each other and extending along an imaginary helix positioned on the outer peripheral surface. Each feed vane is shaped so that it spreads in a fan type manner from the region or foot where it is attached to the outer peripheral surface of the drive shaft to its radially outer edge. Further, means is provided for feeding heating fluid into the hollow portions of the feed vanes through the hollow portions of the aforesaid hollow drive shafts.

In this invention, as the hollow drive shafts are rotated, a material to be dried is conveyed by the plurality of feed vanes extending along the imaginary helix positioned on the outer peripheral surface of each drive shaft. Therefore, since, in each space defined between neighboring feed vanes, the material is not conveyed by the feed vanes, the rate of travel of the material, as a whole, is reduced, making it possible for the material to stay longer in the casing, with the result that the material can be fully dried.

Further, since neighboring drive shafts are rotated in mutually opposite directions, the feed vanes attached to neighboring drive shafts will convey the material while stirring it. The stirring of the material can be effected to the fullest extent and can be uniformally heated.

If each feed vane is constructed to have a predetermined thickness, a stirring effect is produced on the material by the front lateral end end of the feed vane, i.e., its lateral end edge positioned forward as viewed in the direction of rotation. Thus, the material can be heated more uniformally. Further, by making smaller the angle at which the feed vanes are attached to the drive shafts, i.e., by reducing the angle enclosed between a tangent to the imaginary helix positioned on the outer peripheral surface of each drive shaft and the cross-sectional plane of the drive shaft, it is possible to reduce the rate of travel of the material and hence to dry the material more fully.

Further, by suitably selecting the spacing between neighboring feed vanes, it is possible to feed back part of the material in the direction opposite to the direction of conveyance and hence to stir the material more fully and to reduce the rate of travel of the material.

These objects and other objects, features, aspects and advantages of the present invention will become more apparent from the following detailed description of the present invention when taken in conjunction with the accompanying drawings.

BRIEF DESCRIPTION OF THE DRAWINGS

FIG. 6A is a sectional view, taken perpendicularly to the direction of the drive shaft, looking at feed vanes provided on one drive shaft of two neighboring drive shafts, FIG. 6B is a sectional view, taken perpendicularly to the direction of the drive shaft, looking at feed vanes provided on the other drive shaft of two neighboring drive shafts, and FIG. 7 is a schematic view showing the relationship between feed vanes provided on neighboring drive shafts;

DESCRIPTION OF THE PREFERRED EMBODIMENTS

Figure 1:
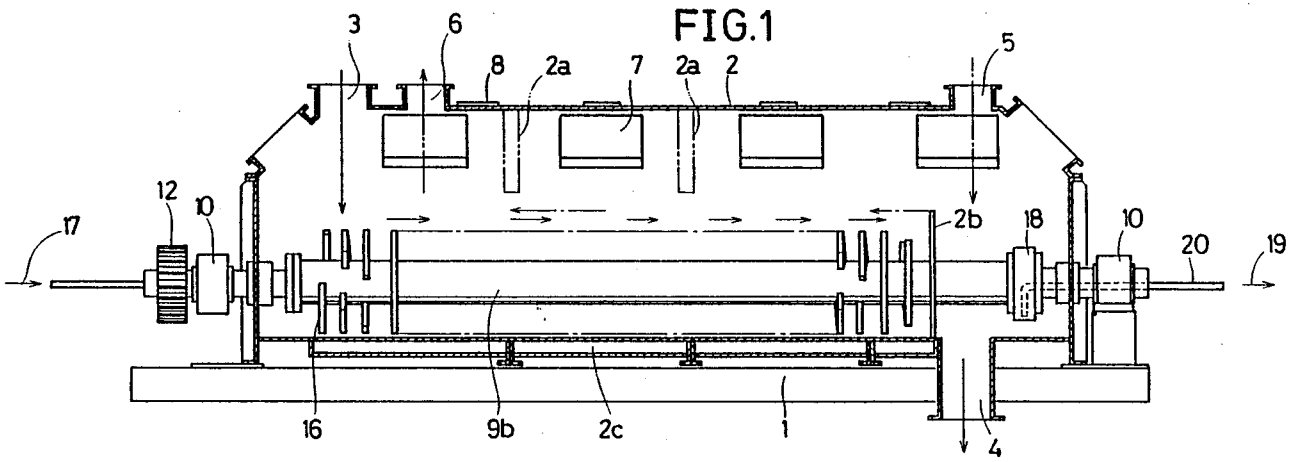
FIG. 1 is a side view, partly in section, of a screw conveyor type drying apparatus according to this invention.
Figure 2:
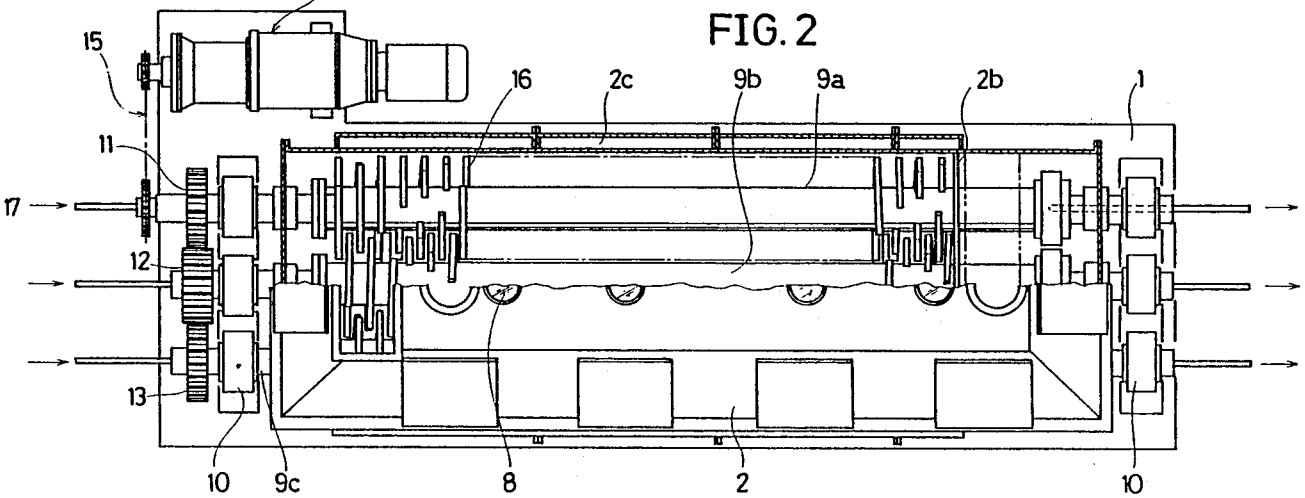
FIG. 2 is a top plan view, partly in section, of the screw conveyor type drying apparatus shown in FIG. 1.
Figure 3:
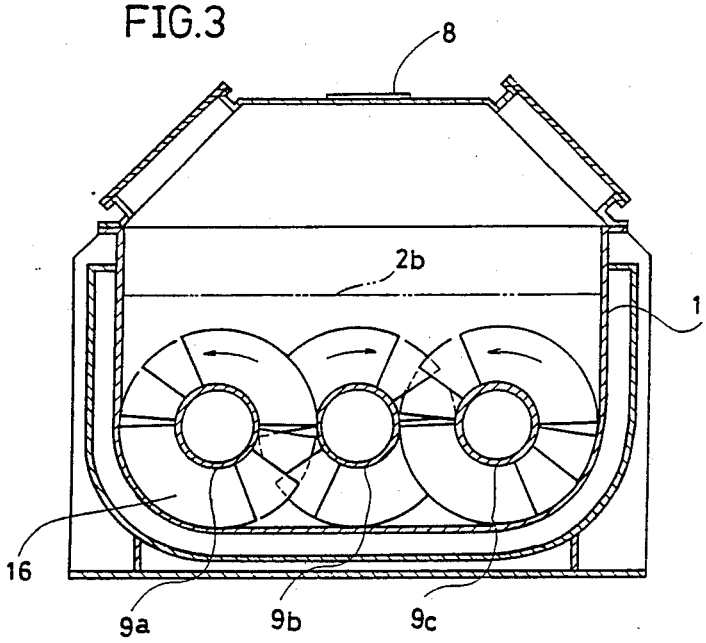
FIG. 3 is an end view, partly in section, of the present screw conveyor type drying apparatus.

Referring to FIGS. 1 to 3, casing 2 is mounted on a base 1. The casing 2 has an inlet port 3 on the upper side thereof for material to be dried. The inlet 3 is disposed adjacent one end of the casing 2. A discharge port 4 for dried material is disposed adjacent the other end on the lower side of the casing 2 which also has an air supply port 5 disposed above the discharge port 4 and an exhaust port 6 disposed adjacent to the inlet port 3. Hot air at 80°-100° C. is fed into the casing 2 through the air supply port 5 and discharged through the exhaust port 6. A plurality of inspection doors 7 are disposed in the upper region of the casing 2 and spaced along the length thereof. Further, a plurality of inspection windows 8 are provided in the upper surface of the casing 2 for inspecting the interior of the casing 2. Further, inside the casing 2, a plurality of baffle plates **2*a* (shown in phantom lines) suspended from above are spaced in the direction of conveyance. The plates 2*a* divide the upper region of the interior of the casing 2 into a plurality of spaces. A heating jacket 2*c* surrounds the casing 2. Heating fluid 17 to be described below is circulated in the jacket 2*c*, so that a material to be dried which is charged into the apparatus can be dried by coming in contact with the inner wall of the jacket 2** as well as with feed vanes to be described below.

A plurality of, i.e., three, hollow drive shafts **9*a*, 9*b* and 9*c* are disposed in parallel to one another inside the casing 2. The opposite ends of each of the drive shafts project outside the casing 2 and are rotatably supported in bearings 10. The drive shafts 9*a*, 9*b* and 9*c* have transmission gears 11, 12 and 13 of the same size coaxially fixed thereto at one of their respective ends. The transmission gears 11 and 13 mesh with the centrally disposed transmission gear 12, whereby the drive shafts 9*a* and 9*c* disposed at opposite sides are rotated in the same direction and the central drive shaft 9*b* is rotated in a direction opposite to that of the other drive shafts 9*a* and 9*c*. All three drive shafts rotate at the same speed. The drive shaft 9*a* is connected to a driving motor 14 serving as a rotative drive source through a chain transmission mechanism 15, whereby the power from the motor 14 is transmitted to the drive shaft 9*a* through the chain drive mechanism 15. Thus, the drive shaft 9*a* is driven for rotation by the motor 14 and the drive shafts 9*b* and 9*c* are rotated by the transmission gears 11, 12 and 13 at the same speed as the drive shaft 9*a***.

A weir **2*b* is disposed in the casing 2 immediately upstream of the discharge port 4, so that the material must go over the weir 2*b* before it can be discharged through the discharge port 4. Thus, the material can be fully dried and then discharged through the discharge port 4. The weir 2*b*** may have an adjustable height. In that case the staying time for the material can be adjusted and hence the degree of drying of the material can be adjusted.

Figure 4:
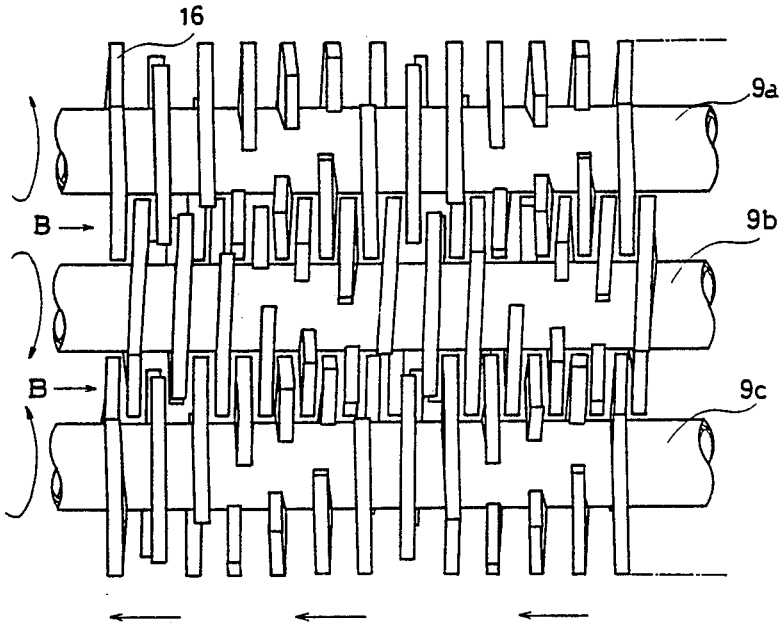
FIG. 4 is a plan view showing a plurality of drive shafts in the embodiment of FIG. 1 embodiment and feed vanes provided on the drive shafts.

As shown in FIG. 4, several sectorial feed vanes 16 are spaced around each of the drive shafts **9*a*, 9*b* and 9*c* at a predetermined distance from one another along an imaginary helix positioned on the outer peripheral surface of each of the drive shafts 9a, 9b and 9c**. The construction of the plurality of feed vanes will now be described in detail.

Figure 5:
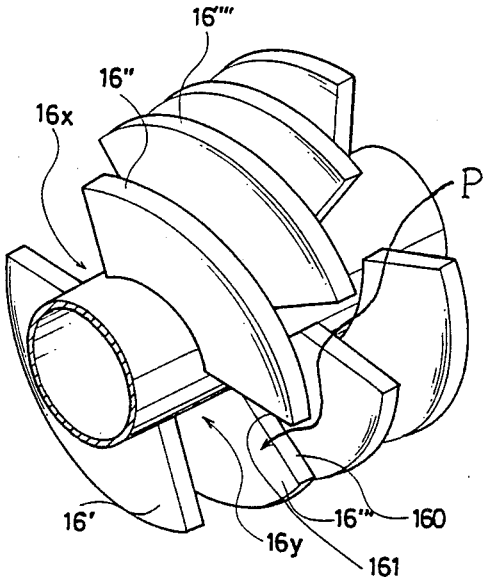
FIG. 5 is a perspective view showing a plurality of feed vanes secured to a drive shaft.

As shown in FIG. 5, the feed vanes 16 are attached to the periphery of the drive shaft 9a in such a manner that the imaginary helix which is the path described by the attaching portions of the feed vanes 16 is right-handed. Similarly, the imaginary helix which is the path described by the attaching portions of the feed vanes 16 attached to the drive shaft 9c is right-handed. On the other hand, the imaginary helix which is the path described by the attached portions of the feed vanes 16 attached to the outer peripheral surface of the central drive shaft 9b is left-handed. Since the drive shafts 9a and 9c are rotated in the direction opposite to that of the drive shaft 9b, that is, since the drive shafts 9a and 9c are rotated counterclockwise as viewed from the charge side in the direction of the drive shaft, while the other drive shaft 9b is rotated clockwise, the attachment of the feed vanes in the manner described above makes it possible to move the material in a direction of forward movement from the inlet to the outlet. Thus, if the drive shafts 9a to 9c are rotated in directions opposite to those described above, the feed vanes 16 will be attached so that the imaginary helixes ar reversed in winding direction.

Figure 6A:
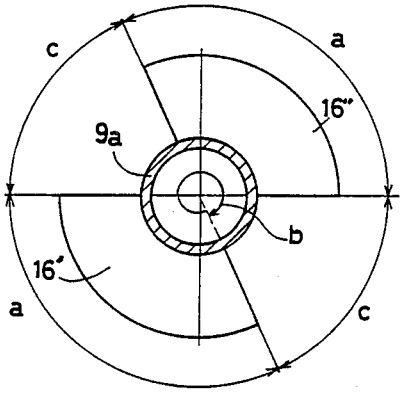
FIGS. 6A, 6B and 7 are views for explaining the relationship between the feed vanes provided on neighboring drive shafts.

The feed vanes 16 are attached to each of the drive shafts 9a, 9b and 9c in such a manner that they are paired and the pairs are spaced a predetermined distance from each other along the imaginary helix on the outer peripheral surface of the respective drive shaft. That is, as shown in FIG. 5, on the outer peripheral surface of a drive shaft, a first pair of vanes comprises feed vanes 16' and 16''. A second pair of feed vanes 16'' and 16''' is located next to the first pair. A third and fourth pair of vanes are shown, but not provided with reference numbers. Assuming the shaft rotates clockwise as viewed, then the edge surface 160 of the feed vane 16''' is a trailing edge and the surface 161 of the vane 16'' is a leading edge. The trailing edge 160 of the vane 16''' is spaced 3 pitches plus 30° from the leading edge 161 of the feed vane 16'' of the preceding pair of feed vanes 16' and 16''. Herein, 1 pitch means the distance traveled by the helix as it is rotated through 360° around the outer peripheral surface of the drive shaft. The feed vanes 16' and 16'' in the first pair are each constructed to have a spread with a central angle of about 115° and are attached in such positions that they are shifted by sectorial spaces 16x and 16y each having a central angle of 65° within 1 pitch. This relationship will now be described with reference to FIGS. 6A and 7. FIG. 6A is a sectional view, taken in a direction perpendicularly to the drive shaft, looking at the first pair of feed vanes 16' and 16''. A curve 9A in FIG. 7 indicates the imaginary helix positioned on the outer peripheral surface of the drive shaft 9a to which the feed vanes 16' and 16'' are attached. The portions of the curve indicating where the feed vanes 16' and 16'' are attached to the drive shaft are shown in thick lines. The characters a, b, and c in FIG. 7 correspond to a, b and c in FIG. 6A and the character d represents the distance between a pair of feed vanes and the next pair of feed vanes.

Figure 7:
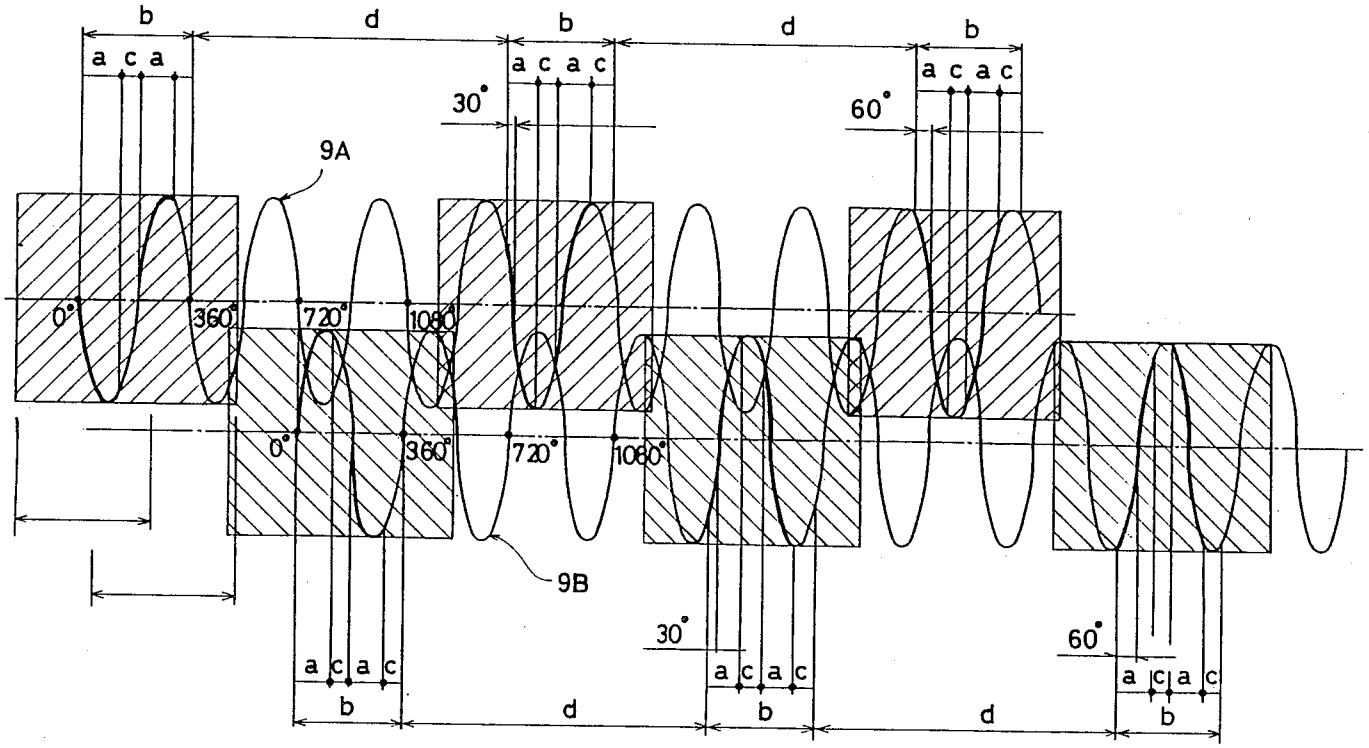

As is clear from FIG. 6A and the curve 9A in FIG. 7, the pair of feed vanes 16' and 16'' are mounted on the drive shaft 9a as they are shifted by spacings c, c of 65°, corresponding to the spaces 16x and 16y in FIG. 5, within 1 pitch, i.e., within 360°. The feed vanes 16''' and 16'''' of the next pair of feed vanes are attached in positions shifted by 360°×3 (3 pitches)+30°.

The spacings 16x and 16y between adjacent feed vanes are selected on the following basis. That is, when the central angle defining the spacing where there are no feed vanes is represented by $\alpha$, the pair of feed vanes, if uniformally arranged, are disposed with an angular spacing of $\beta=(360°-2)/2$. In this case the next pair of feed vanes behind the first pair of feed vanes is disposed with a spacing of 3 pitches+about $\beta/2$ from the preceding pair of feed vanes. The reason why adjacent pairs of feed vanes are disposed with such a relatively large spacing is that it is necessary to provide a space therebetween for receiving feed vanes attached to the outer peripheral surface of the neighboring drive shaft. The reasons for providing a shift amounting to a spacing of about $\beta/2$ between neighboring pairs is as follows. As shown in FIG. 5, it is described that the next pair of feed vanes 16''' and 16'''', as viewed in the axial direction, overlaps the preceding pair over regions of about ½ of the respective spaces 16x and 16y, whereby successive pairs of feed vanes successively cut into the material to be dried, effectively saving driving power. Further, in such an arrangement with axially and helically shifted spaced 16x and 16y, part of the material is fed back in the direction indicated by arrow P opposite to the direction of conveyance as shown in FIG. 5, thereby making it possible to obtain sufficient drying time. The presence of these spaces 16x and 16y ensures a smooth action by the feed vanes cutting into the material to be dried.

In the embodiment described above, when the central angle $\alpha$ representing the spaces 16x and 16y is set at 115° on the basis of the aforesaid reasons for selection, the angle $\beta$ is 65°. Thus, pairs of feed vanes on the respective drive shafts are shifted from each other by a spacing of 3 pitches+about $\beta/2$, or 3 pitches+about 30°.

Figure 8:
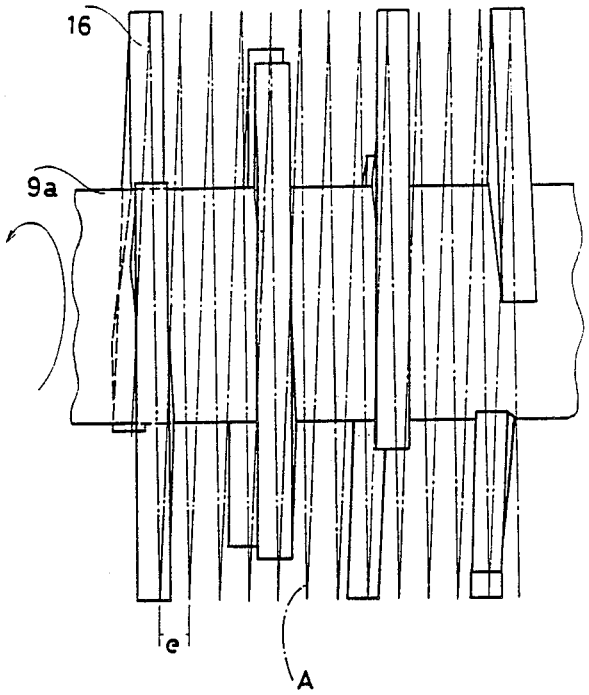
FIG. 8 is a fragmentary side view for explaining the pitch of feed vanes provided on a drive shaft.

In addition, as shown in FIG. 8, the feed vanes 16 attached to the drive shaft 9a form a relatively small angle with the direction which is at right angles to the axis of the drive shaft. That is, each feed vane 16 is attached so that a small angle is formed between a tangent to the aforesaid imaginary helix and a cross-sectional plane perpendicularly through the drive shaft, whereby it is possible to reduce the rate of conveyance of material to be dried and hence to provide sufficient drying time.

Further, in this embodiment, the thickness of the feed vanes 16 is approximately equal to the distance e traveled by the aforesaid helix per one shaft revolution. However, the thickness of the feed vanes may differ from e.

Figure 9:
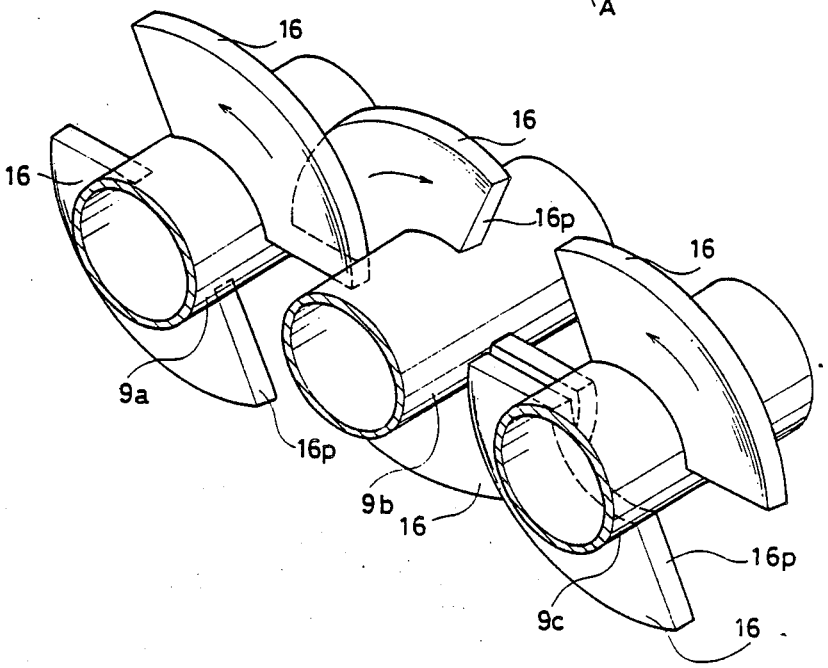
FIG. 9 is a perspective view showing the relationship between feed vanes provided on neighboring drive shafts.

The relationship between feed vanes attached to the drive shafts 9a . . . 9c will now be described. As shown in FIG. 9, feed vanes attached to neighboring drive shafts 9a . . . 9c, are located at symmetrical positions for meshing. In other words, the vanes on the middle shaft 9b mesh with the vanes on both neighboring shafts 9a and 9c. Further, the central drive shaft 9b is supported at a position which deviates somewhat from the positions of the drive shafts 9a and 9c on opposite sides toward the discharge port 4 of the casing 2. Thus, the feed vanes 16 on the drive shaft 9a are fitted, in staggered relationship, between the feed vanes 16 on the drive shafts 9a and 9c, to provide overlap portions B shown in FIG. 4 between neighboring feed vanes.

Figure 6B:
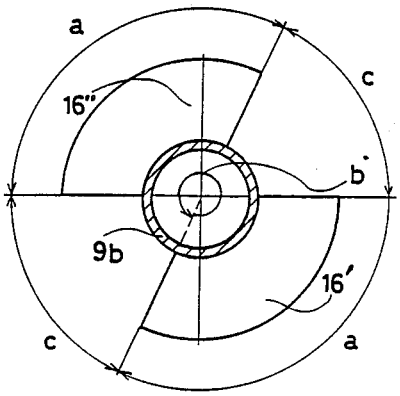

By comparing FIG. 6B showing feed vanes 16' and 16'' attached to the drive shaft 9b in the same manner as in FIG. 6A and the curve 9B (FIG. 7) showing the imaginary helix on the drive shaft *9b*, with the curve 9A showing the imaginary helix on the drive shaft *9a*, the relationship between feed vanes on adjacent drive shafts can be better understood. That is, feed vanes in each pair attached along the imaginary helix 9A on the drive shaft *9a* are fitted between feed vanes in each pair on the neighboring drive shaft *9b*.

Figure 14:
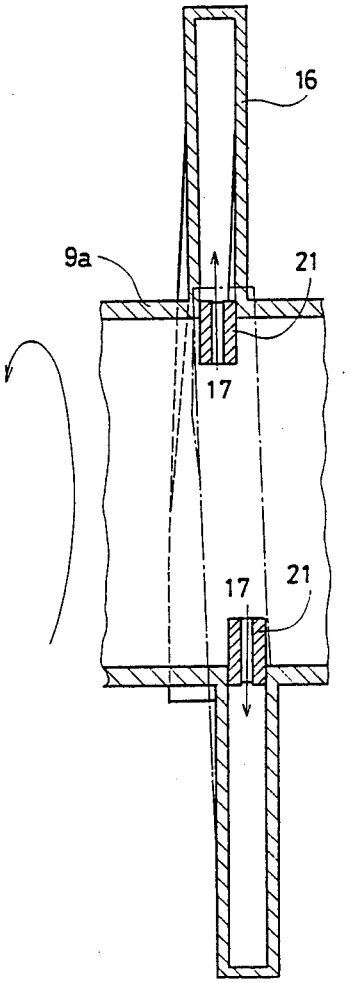
FIG. 14 is a sectional view taken along the line XIV—XIV in FIG. 13.
Figure 13:
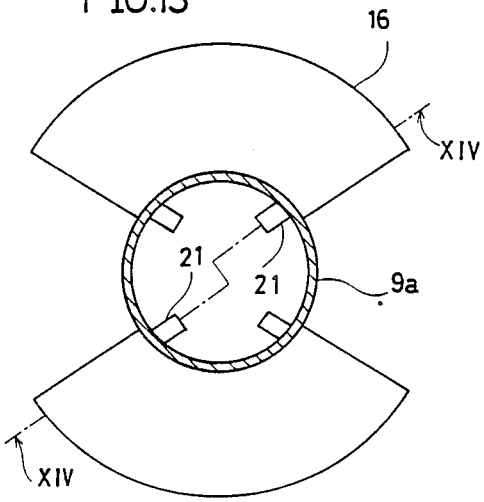
FIG. 13 is a sectional view, taken perpendicularly to the direction of the drive shaft, for explaining drain pipes projecting from feed vanes into the hollow portion of the drive shaft.

Heating fluid, such as steam indicated by an arrow 17, is fed into the drive shafts *9a*, *9b* and *9c* at one of their respective ends adjacent the charge port 3. As shown in FIGS. 13 and 14, drain pipes 21 project from the hollow portions of the feed vanes into the interior of the drive shaft *9a*. Thus, heating fluid 17 is fed into the feed vanes 16 and is condensed in said feed vanes 16, while the condensate is discharged into the interior of the drive shaft *9a* through the drain pipes 21. The inwardly projecting drain pipes 21 are so directed that condensated fluid can flow out of the respective vane when the vane is in an up-position, but is prevented from entering into a vane in a down-position. Thus, in this embodiment, since the heating fluid 17 which has condensed hardly enters the feed vanes 16, the feed vanes 16 can be maintained at a high temperature all the time and hence the material which comes in contact with the feed vanes 16, can be efficiently dried.

Figure 12:
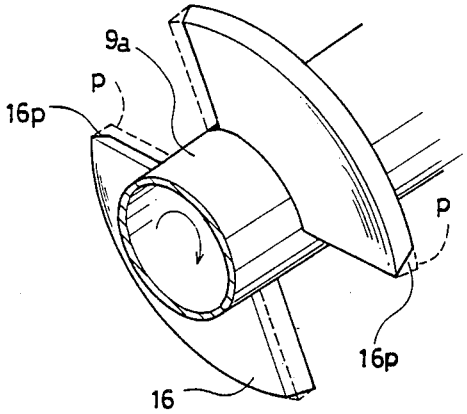
FIG. 12 is a perspective view of a modification of a feed vane constructed so that the lateral end surface is formed as an inclined surface which opens toward the discharge side.

Further, as is clear from FIGS. 8, 9 and 12, each feed vane 16 has a predetermined thickness and hence lateral end surfaces 16*p* extending from opposite ends of the attaching portion along the imaginary helix to the front or radially outer end of the feed vane 16. Therefore, the material disposed forward in the direction of rotation can be stirred by the lateral end surface 16*p*. Preferably, the lateral end surface 16*p* disposed forward in the direction of the rotation, is an inclined surface which opens toward the discharge port 4 of the conveying device, as shown in FIG. 12, so that said lateral end surface 16*p* itself has the function of conveying material to be dried, thereby making it possible to increase the rate of conveyance of said material. Reversely, as shown in broken lines p, if the lateral end surface 16*p* is an inclined surface which is closed with respect to the discharge port 4 of the casing 2, the lateral end surface 16*p* will serve to move the material in the direction opposite to the direction of conveyance. When it is desired to reduce the rate of conveyance to thereby provide sufficient drying time, this can be attained by forming the lateral end surface 16*p* in the manner shown in broken lines p.

In addition, the radial dimension of the feed vanes 16 is so selected that the peripheral edges reach close to the outer peripheral surfaces of the neighboring drive shaft. With this arrangement, the material adhering to the outer peripheral surfaces of the adjacent drive shaft can be scraped off by the radially outer edges of the feed vanes 16, so that the stirring and drying of the material becomes more efficient. In order to attain such a merit, however, it is necessary to take into account not only the radial dimension of the feed vanes 16 but also the outer diameter of the drive shafts. Thus, preferably the distance between neighboring drive shafts and the radial dimension of the feed vanes are selected in such a manner that the material adhering to the outer peripheral surface of a drive shaft is removed by the feed vanes attached to the adjacent drive shafts.

The operation of the screw conveyor type drying apparatus disclosed above will now be described.

A material to be dried is charged into the casing 2 through the inlet port 3. The material is gradually conveyed from the inlet port 3 toward the discharge port 4 by the feed vanes 16 provided on the drive shafts *9a*, *9b* and *9c*. During travel in the casing 2, the material comes in contact with the outer surfaces of the feed vanes 16 and drive shafts *9a*, *9b* and *9c* heated by the heating fluid 17 and is thereby dried. The dried material travels over the weir *2b*, whereupon it is discharged through the discharge port 4 out of the apparatus.

Since the feed vanes 16 described above are provided not continuously along the imaginary helix on each of the drive shafts *9a*, *9b* and *9c* but with a predetermined spacing 16*x*, 16*y* between adjacent feed vanes 16, the feeding of the material does not take place in the spaces between adjacent feed vanes 16. As a result, the material is fed very slowly in the casing 2; thus, it stays in the casing 2 for a duration providing a sufficient drying time.

Further, since the sectorial feed vanes 16 are provided on the drive shafts *9a*, *9b* and *9c* with a predetermined spacing between adjacent feed vanes, the material is moved while being raised and depressed by the end surfaces of the feed vanes 16 as the drive shafts *9a*, *9b* and *9c* are rotated. Thereby, the material is efficiently stirred.

Figure 10:
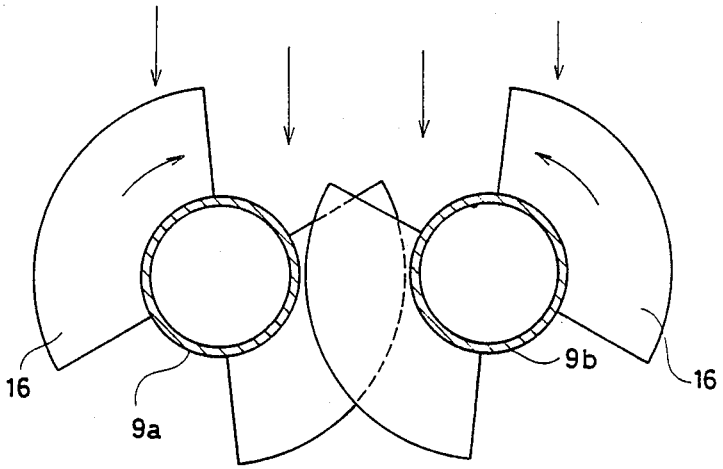
FIGS. 10 and 11 are sectional views, taken perpendicularly to the direction of the drive shafts, illustrating the action of feed vanes provided on neighboring drive shafts.
Figure 11:
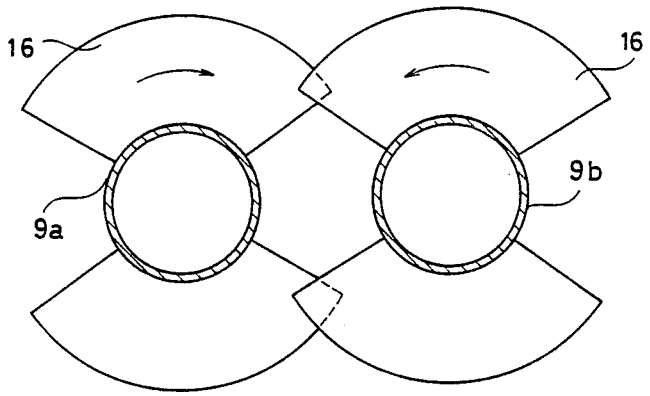

The size of the above mentioned overlap portions or regions B between the sector shaped feed vanes 16 on the central drive shaft *9b* and the sector shaped feed vanes 16 on the drive shafts *9a* and *9c*, increases and decreases as the shafts rotate in opposite directions, as shown in FIGS. 10 and 11. In FIG. 10 there is an optimal overlap between vanes 16 facing each other and in this position the space above the overlapping feed vanes 16 is large so that the material in this space tends to fall between overlapping feed vanes 16. In FIG. 11 the overlap is small but the material passing through the overlapping region has been rotating in opposite directions, whereby the material is loosened. Thus, lumps of material are broken up. This breaking action of the overlapping vane portions B on lumps of material also prevents the material from adhering to the surfaces of the feed vanes 16.

Further, since axially spaced forwardly and rearwardly feeding vanes disposed on the drive shafts *9a*, *9b* and *9c*, are shifted in increments of 30° in planes at right angles to the axial direction, the feed vanes 16 do not simultaneously cut into the material but do so axially in succession, whereby the power for driving the shafts *9a*, *9b* and material is facilitated.

Further, in the case where the central angle of the feed vanes 16 is 115° as described above, three plates for making feed vanes 16 can be cut from a single disk, a fact which means a reduction in manufacturing cost.

If the drive shafts *9a*, *9b* and *9c* are reversed in direction of rotation, i.e., if the drive shafts *9a* nd *9c* are rotated clockwise as viewed from the side associated with the charge port and the central drive shaft *9b* is rotated counterclockwise, the material will be fed from the side associated with the discharge port 4 toward the side associated with the charge port 3. Thus, by adapting the apparatus so that the drive shafts *9a*, *9b* and *9c* can be driven for rotation both forwardly and backwardly, the residence time for the material in the casing can be adjusted and the stirring action on the material can be enhanced.

Since the feed vanes 16 provided on each drive shaft, when viewed in the axial direction, are shifted in increments of 30°, the spaces between feed vanes in successive pairs on each of the drive shaft 9a, 9b and 9c are serially connected together (see FIG. 5). Thus, part of the material travels in a direction opposite to the direction of conveyance and hence the material can be dried to a fuller degree.

In the screw conveyor type drying apparatus described above, three hollow drive shafts have been provided. However, four or more hollow drive shafts may be arranged to form a screw conveyor type drying apparatus.

While the feed vanes 16 attached to the drive shafts 9a . . . 9c have been shown having a sectorial form, they are not limited to that shape but may take any other form provided that they spread radially outwardly.

Figure 1A:
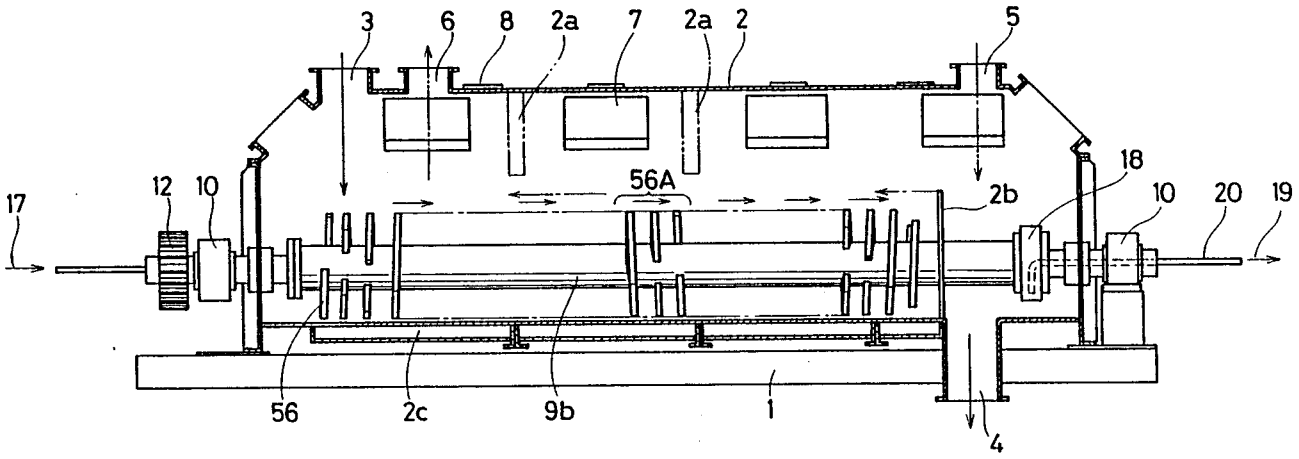
FIG. 1A is a side view, partly in section, of a modification of the screw conveyor type drying apparatus shown in FIG. 1.

As mentioned, the pitch directions of helixes on different drive shafts may differ for controlling the feed direction. However, even on the same drive shaft there may be groups 56, 56A of vanes arranged along helixes having different pitch directions, as shown in FIG. 1A. For example, the feed vanes 56 provided on the outer peripheral surface of the drive shaft 9b may include a group of vanes 56A disposed along such a helix as will move part of the material in the direction opposite to the normal feed direction. In this case, the corresponding portions of the adjacent drive shafts will be provided with feed vanes similar to those of group 56A. This arrangement also makes it possible to increase the staying time for the material and to stir the material to a fuller degree.

Figure 15:
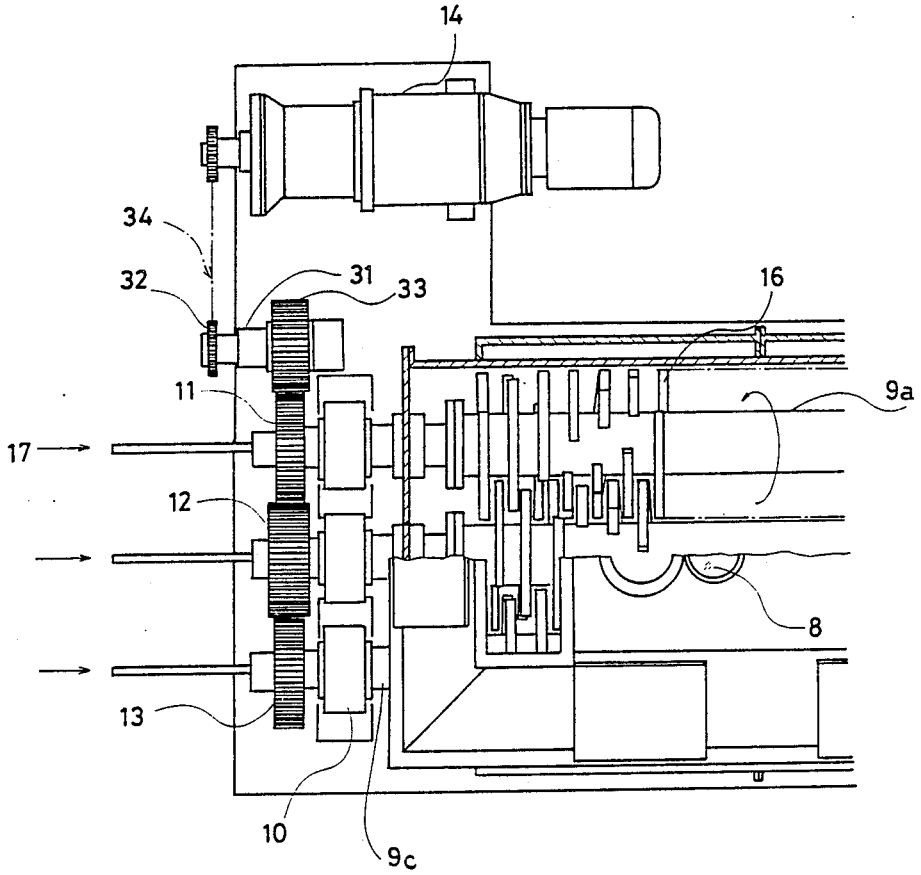
FIG. 15 is a plan view, partly broken away, showing another example of a mechanism for driving a plurality of drive shafts.
Figure 16:
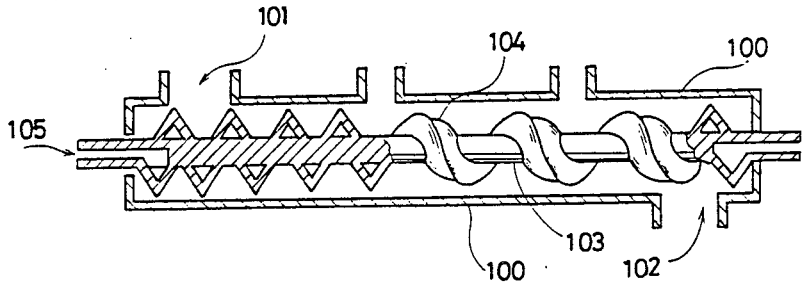
FIG.16 PRIOR ART
FIG. 16 is a sectional view of an example of a conventional screw conveyor type drying apparatus.
Figure 17:
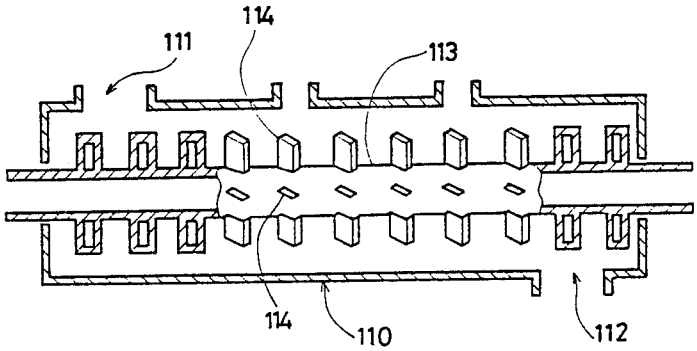
FIG.17 PRIOR ART
FIG. 17 is a sectional view of another example of a conventional screw conveyor type drying apparatus.
Figure 18:
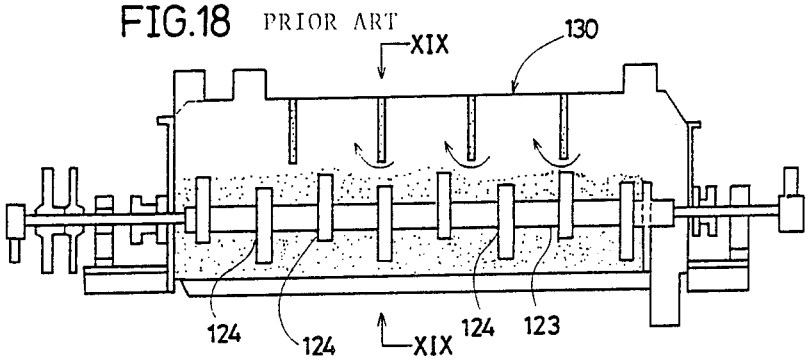
FIG.18 PRIOR ART
FIGS. 18 and 19 are a front sectional and a sectional view taken along the line XIX—XIX in FIG. 18, respectively, of a further conventional screw conveyor type drying apparatus.
Figure 19:
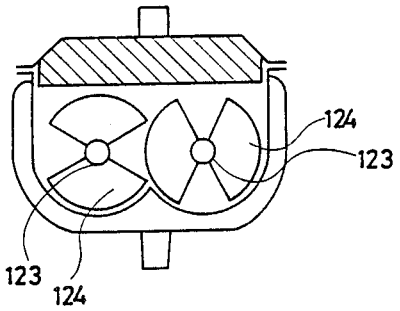
FIG.19 PRIOR ART

In the apparatus shown in FIGS. 1 and 2, the hollow drive shaft 9a has been connected to the drive motor 14 through the chain drive 15. However, as shown in FIG. 15, a relay idle shaft 31 may be provided between the motor 14 and the transmission gear 11 mounted coaxially on the front end of the hollow drive shaft 9a. In this case, the relay idle shaft 31 is coaxially provided with a sprocket 32 and a transmission gear 33, the sprocket 32 being connected to the motor 14 by a chain drive 34, the transmission gear 33 meshing with the transmission gear 11 coaxially provided on the hollow drive shaft 9a. Thus, the tension from the chain drive 34 is applied only to the relay idle shaft 31. Since the tension is not transmitted to the hollow drive shaft 9a, the latter can be rotated more stably than in the case of the apparatus shown in FIGS. 1 and 2. However, for the transmission of the rotative power of the motor 14 to the drive shafts 9a . . . 9c, it is not absolutely necessary to use the aforesaid chain drives 15 and 34. Other transmission means such as a desired number of transmission gears may be used.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A conveyor type drying apparatus, comprising a casing having a material charging inlet port and a material discharging outlet port which are spaced from each other by a first predetermined distance in a normal direction of conveyance from said inlet port to said outlet port, a plurality of hollow drive shafts rotatably mounted in said casing, said hollow drive shafts having longitudinal axes extending in said normal direction of conveyance, drive means operatively connected to said hollow drive shafts for driving said plurality of hollow drive shafts so that neighboring drive shafts are rotated in mutually opposite directions, a plurality of feed vanes of hollow construction spaced at a second predetermined distance from each other along said hollow drive shafts, each of said hollow feed vanes having a foot connected to its hollow drive shaft, said plurality of hollow feed vanes including a first group of hollow feed vanes connected along a first imaginary helix having a first pitch positioned on the outer peripheral surface of each of said drive shafts, said plurality of hollow feed vanes including a second group of hollow feed vanes having their feet connected to at least one hollow drive shaft along a second imaginary helix having a second pitch, each of said hollow feed vanes of said first and second groups of feed vanes having a peripheral edge longer than its foot so that each feed vane spreads in a fan type manner radially outwardly, means for feeding heating fluid into the hollow portions of the feed vanes through said hollow drive shafts, said second pitch of said second imaginary helix being wound in a direction opposite to said first pitch of said first imaginary helix, so that said second group of feed vanes move a material to be dried in a direction opposite to said normal direction of conveyance, as the respective drive shaft is rotated, for prolonging the residence time of material in said casing.

2. The screw conveyor type drying apparatus of claim 1, wherein each of said hollow feed vane has a substantially sectorial shape.

3. The screw conveyor type drying apparatus of claim 1, wherein said plurality of hollow feed vanes in both groups are arranged in pairs on the outer peripheral surface of each of said hollow drive shafts, and wherein said first pitch and said second pitch are the same but wound in opposite directions.

4. The screw conveyor type drying apparatus of claim 3, wherein said hollow feed vanes in each pair are spaced from each other by an angular spacing $\beta=(360°-2\alpha)/2$ as seen in the direction of the drive shaft, wherein $\alpha$ is the central angle of each hollow feed vane defining its fan type spread, and wherein pairs of hollow feed vanes following a first pair are arranged so that each pair is shifted from a preceding pair by three pitches+about $\beta/2$.

5. The screw conveyor type drying apparatus of claim 4, wherein said central angle $\alpha$ is 115° and said angular spacing $\beta$ is 65°, as seen in the direction of the drive shaft, and wherein a pair of hollow feed vanes is shifted by about 30° in a pitch direction from the preceding pair of hollow feed vanes.

6. The screw conveyor type drying apparatus of claim 1, wherein said hollow feed vanes have a predetermined thickness substantially in said conveyance direction so that each hollow feed vane has lateral end surfaces extending substantially radially from a foot of said feed vane attached to the respective drive shaft, said lateral end surfaces having an area sufficient for influencing said material to be dried.

7. The screw conveyor type drying apparatus of claim 6, wherein of said lateral end surfaces the surface facing forward in the direction of rotation is an inclined surface so as to face toward the discharge port so that a material to be dried coming into contact with said lateral end surface is moved by said lateral end surface in the direction of conveyance as the drive shafts are rotated.

8. The screw conveyor type drying apparatus of claim 6, wherein of said lateral end surfaces the surface facing forward in the direction of rotation is an inclined surface so as to face away from the discharge port so that a material to be dried coming into contact with said lateral end surface is moved by said lateral end surface in the direction opposite to the direction of conveyance as the drive shafts are rotated.

9. The screw conveyor type drying apparatus of claim 1, further comprising pipes for communicating a hollow interior of each feed vand with an interior of said hollow drive shafts, said drain pipes projecting from the foot of the respective feed vane into the interior of the drive shaft, in such directions that reentry of cooled heating fluid into the feed vanes is prevented.

10. The screw conveyor type drying apparatus of claim 1, further comprising a weir located at a position closer to said discharge port than are the hollow feed vanes, said weir being mounted in said casing at a position upstream of said dried material discharging port as viewed in said conveying direction.

11. A conveyor type drying apparatus, comprising a casing having a material charging inlet port and a material discharging outlet port which are spaced from each other by a first predetermined distance in a normal direction of lityeyance from said inlet port to said outlet port, a plurality of hollow drive shafts rotatably mounted in said casing, said hollow drive shafts having longitudinal axes extending in said normal direction of conveyance, drive means operatively connected to said hollow drive shafts for driving said plurality of hollow drive shafts so that neighboring drive shafts are rotated in mutually opposite directions, a plurality of pairs of feed vanes of hollow constructon spaced at a second predetermined distance from each other and extending along the outer peripheral surface of each of said drive shafts, each feed vane having a foot connected to its respective drive shaft and a peripheral edge longer than said foot so that each feed vane spreads in a fan type manner radially outwardly, means for feeding heating fluid into the hollow portions of the feed vanes through said hollow drive shafts, wherein first pairs of feed vanes of said plurality of pairs of feed vanes are connected with their feet to the outer peripheral surface of each of said hollow drive shafts along a first imaginary helix having a first pitch, at least one second pair of said hollow feed vanes being connected to at least one of said shafts along a second imaginary helix having a second pitch which is the same pitch as said first pitch of said first imaginary helix, said second pitch being wound in a direction opposite to that of said first pitch.

12. A conveyor type drying apparatus, comprising a casing having a material charging inlet port and a material discharging outlet port which are spaced from each other by a first predetermined distance in a direction of conveyance, a plurality of hollow drive shafts rotatably mounted in said casing, said hollow drive shafts having longitudinal axes extending in the direction of conveyance, drive means operatively connected to said hollow drive shafts for driving said plurality of hollow drive shafts so that neighboring drive shafts are rotated in mutually opposite directions, a plurality of feed vanes of hollow construction spaced at a second predetermined distance from each other and extending along a first imaginary helix positoned on the outer peripheral surface of each of said drive shafts, each feed vane having a foot connected along said imaginary helix to its respective drive shaft and a peripheral edge longer than said foot so that each feed vane spreads in a fan type manner radially outwardly, means for feeding heating fluid into the hollow portions of the feed vanes through said hollow drive shafts, and wherein said hollow feed vanes have a predetermined thickness substantially in said conveyance direction so that each hollow feed vane has lateral end surfaces extending substantially radially from a foot of said feed vane attached to the respective drive shaft, said lateral end surfaces having an area sufficient for influencing the feeding of said material to be dried.

13. A conveyor type drying apparatus, comprising a casing having a material charging inlet port and a material discharging outlet port which are spaced from each other by a first predetermined distance in a direction of conveyance, a plurality of hollow drive shafts rotatably mounted in said casing, said hollow drive shafts having longitudinal axes extending in the direction of conveyance, drive means operatively connected to said hollow drive shafts for driving said plurality of hollow drive shafts so that neighboring drive shafts are rotated in mutually opposite directions, a plurality of feed vanes of hollow construction spaced at a second predetermined distance from each other and extending along a first imaginary helix positioned on the outer peripheral surface of each of said drive shafts, each feed vane having a foot connected along said imaginary helix to its respective drive shaft and a peripheral edge longer than said foot so that each feed vane spreads in a fan type manner radially outwardly, means for feeding heating fluid into the hollow portions of the feed vanes through said hollow drive shafts, and further comprising pipes for communicating a hollow interior of each feed vane with an interior of said hollow drive shafts, said pipes projecting from the foot of the respective feed vane into the interior of the drive shaft in such directions that cooled heating fluid is prevented from reentering into said hollow feed vanes.

14. A conveyor type drying apparatus, comprising a casing having a material charging inlet port and a material discharging outlet port which are spaced from each other by a first predetermined distance in a normal direction of conveyance from said inlet port to said outlet port, a plurality of hollow drive shafts rotatably mounted in said casing, said hollow drive shafts having longitudinal axes extending in said normal direction of conveyance, drive means operatively connected to said hollow drive shafts for driving said plurality of hollow drive shafts so that neighboring drive shafts are rotated in mutually opposite directions, a plurality of feed vanes of hollow construction spaced at a second predetermined distance from each other along said hollow drive shafts, each of said hollow feed vanes having a foot connected to its hollow drive shaft, said plurality of hollow feed vanes including a first group of hollow feed vanes connected along a first imaginary helix having a first pitch positioned on the outer peripheral surface of each of said drive shafts, said plurality of hollow feed vanes including a second group of hollow feed vanes having their feet connected to at least one hollow drive shaft along a second imaginary helix having a second pitch, each of said hollow feed vanes of said first and second groups of feed vanes having a peripheral edge longer than its foot so that each feed vane spreads in a fan type manner radially outwardly, means for feeding heating fluid into the hollow portions of the feed vanes through said hollow drive shafts, said second pitch of said second imaginary helix being wound in a direction opposite to said first pitch of said first imaginary helix, so that said second group of feed vanes move a material to be dried in a direction opposite to said normal direction of conveyance, as the respective drive shaft is rotated, for prolonging the residence time of material in said casing, and wherein said hollow feed vanes in each pair are spaced from each other by an angular spacing $\beta=(360°-2\alpha)/2$ as seen in the direction of the drive shaft, wherein $\alpha$ is the central angle of each hollow feed vane defining its fan type spread, and wherein pairs of hollow feed vanes following a first pair are arranged so that each pair is shifted from a preceding pair by three pitches+about $\beta/2$.

* * * * *

UNITED STATES PATENT AND TRADEMARK OFFICE

CERTIFICATE OF CORRECTION

PATENT NO. : 4,761,897

DATED : August 9, 1988

INVENTOR(S) : Mitsuo Tazaki et al.

It is certified that error appears in the above-identified patent and that said Letters Patent is hereby corrected as shown below:

Title page:

In the Abstract [57], line 9, replace "internal" by --interior--;

Claim 9, line 3, replace "vand" by -- vane --;

Claim 11, line 5, replace "lityeyance" by --conveyance--;

Claim 11, line 13, replace "constructon" by --construction--.

Signed and Sealed this

Twenty-first Day of February, 1989

*Attest:*

DONALD J. QUIGG

*Attesting Officer*

*Commissioner of Patents and Trademarks*